United States Patent [19]

Neuhaus

[11] Patent Number: 4,589,289

[45] Date of Patent: May 20, 1986

[54] DEVICE FOR TIGHTENING A SCREW FASTENING, ESPECIALLY FOR TIGHTENING IT BEYOND THE YIELD POINT BY CONTROLLING THE ANGLE OF ROTATION

[75] Inventor: Klaus Neuhaus, Wuppertal, Fed. Rep. of Germany

[73] Assignee: Eduard Wille GmbH & Co., Fed. Rep. of Germany

[21] Appl. No.: 494,789

[22] Filed: May 16, 1983

[30] Foreign Application Priority Data

May 18, 1983 [DE] Fed. Rep. of Germany ... 8214536[U]

[51] Int. Cl.[4] ..... B25B 23/142

[52] U.S. Cl. ..... 73/862.23; 81/483; 73/862.26

[58] Field of Search ..... 73/862.21, 862.22, 862.23, 73/862.26; 29/407; 81/467, 477, 483

[56] References Cited

U.S. PATENT DOCUMENTS

| | | | |
|---|---|---|---|
| 2,007,880 | 7/1935 | Sharp | 73/862.22 |
| 2,074,079 | 3/1937 | Bahr et al. | 73/862.23 |
| 2,300,652 | 11/1942 | Cooney | 73/862.21 |
| 2,614,418 | 10/1952 | Shaff | 73/862.21 |
| 2,756,622 | 7/1956 | LaBelle | 73/862.23 |
| 4,290,329 | 9/1981 | Green | 81/477 |

FOREIGN PATENT DOCUMENTS

| | | | |
|---|---|---|---|
| 679042 | 7/1939 | Fed. Rep. of Germany | 81/483 |
| 795932 | 6/1958 | United Kingdom | 73/862.23 |
| 825282 | 12/1959 | United Kingdom | 73/862.21 |

*Primary Examiner*—Bernard Nozick
*Attorney, Agent, or Firm*—Jones & Askew

[57] ABSTRACT

Device for tightening a screw fastening or the like. The device includes a tubular housing with a head piece for joining with the screw fastening, and a handle for gripping the housing and applying torque thereto. Inside the tubular housing there is a device for adjusting and signaling the torque, as well as a device for measuring the angle of rotation in tightening the screw fastening. The torque device is connected to the angle-of-rotation device in such a way that the angle-of-rotation device is triggered when a certain jointing torque is achieved.

19 Claims, 8 Drawing Figures

DEVICE FOR TIGHTENING A SCREW FASTENING, ESPECIALLY FOR TIGHTENING IT BEYOND THE YIELD POINT BY CONTROLLING THE ANGLE OF ROTATION

The present invention concerns a device for tightening a screw fastening consisting of a tubular housing with a head piece for connecting with the screw fastening and a handle, and more particularly concerns a device having a tubular housing for adjusting and signalling a torque in a screw fastening being tightened and also for measuring the angle of rotation in tightening the screw fastening after achieving the jointing torque.

A screw tool of the type described initially is known from German Patent document No. 2,914,287, where the screw tool has a disk with an angle scale that is coaxial with the axis of rotation of the handle of the tool and an indicator mark that works together with the angle scale so that the disk that has the angle scale and the indicator mark are both coaxial with the axis of rotation of the handle and can be turned toward each other and joined with the screw tool by turning and are also held securely on the work piece. This known screw tool has the advantage that only a single tool is needed to tighten a screw fastening beyond the yield point, but it is first possible to tighten only to the stopping point, i.e., until reaching the jointing torque. Then the disk must be set for the desired angle of rotation and tightening is continued. In this way, the tightening operation must be interrupted for additional manipulations. Likewise, when adjusting one's grip during a tightening operation, which may be necessary for space reasons or because of the posture of the person operating the tool, and for which reason a ratchet is provided, the resulting partial angle of rotation must be read before adjusting the grip and the disk must be adjusted to the remaining angle of rotation before tightening further. This is very time consuming, especially when the tool is gripped several times, and can result in tightening errors. In addition, it is difficult to adjust the angle disk when working in hard-to-reach locations, and it is also difficult to read the angles. In addition, this tool cannot be used for screw fastenings that are almost inaccessible and where there is only a small amount of space for tightening, because the angle disk requires a considerable amount of space and additional space is also necessary in order to be able to adjust the angle disk by hand.

The present invention is now based on the task of improving a device of the type described initially so that the screw fastening can be tightened to the jointing torque, i.e., to the starting point of the angle of rotation measurements, and further tightening beyond the yield point can take place in a continuous tightening process by controlling the angle of rotation and moreover, repeated readjustment of the grip in tightening does not have any effect on the reading of the actual angle of rotation. Furthermore, the device should be compact so that almost inaccessible screw fastenings can be tightened with it and the results can be read easily in the vicinity of the handle of the screw fastening.

According to this invention, this is achieved by having the torque device connected to the angle of rotation device in such a way that when the jointing torque is achieved, the angle of rotation device is triggered. This invention is thus based on the essential idea that the part of the torque device which usually indicates that a certain torque has been achieved, e.g., by means of a visual symbol or an audible sound, is used here to automatically release the angle of rotation measurement device so that tightening can be continued without interruption.

In addition, the present invention also concerns an advantageous device for adjusting and signalling a predetermined torque as well as a device for measuring and recording the angle of rotation in tightening a screw fastening.

On the basis of the practical examples depicted in the accompanying diagrams, this invention will now be explained in greater detail.

Figure 1:
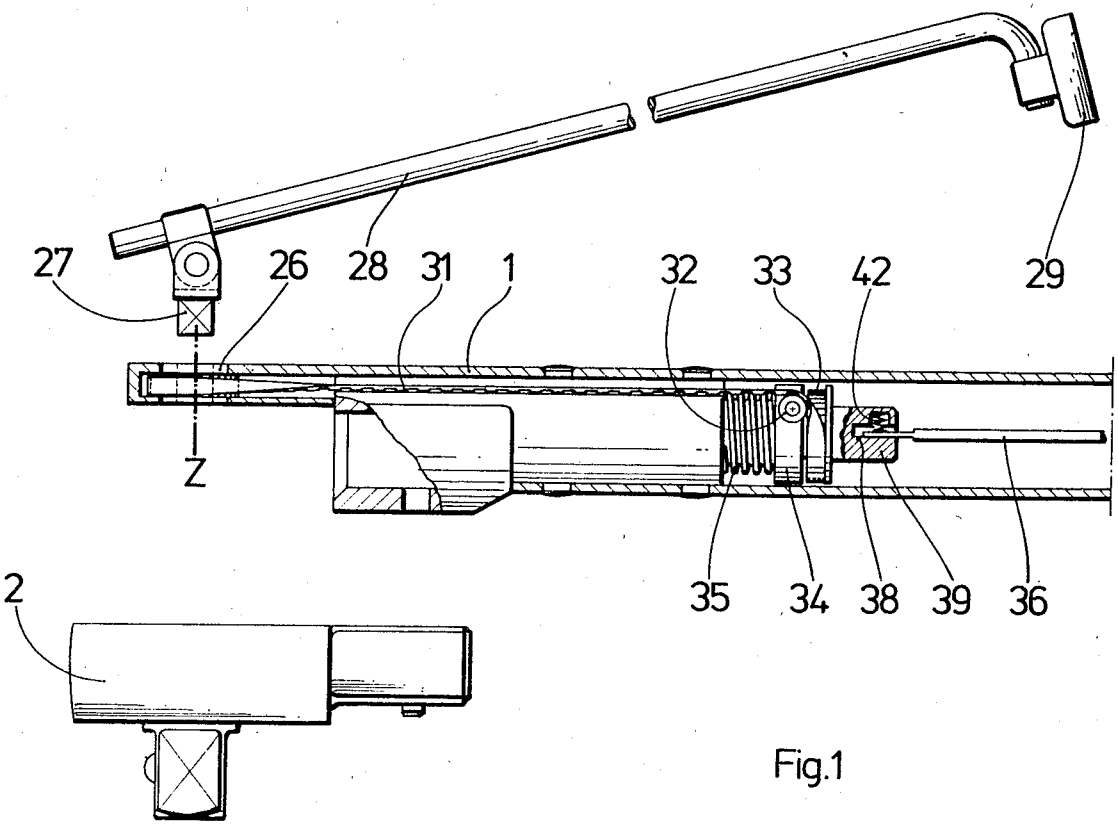
FIG. 1 shows a front elevation view of a device according to this invention and an inserting tool, partially in sectional view.
Figure 2:
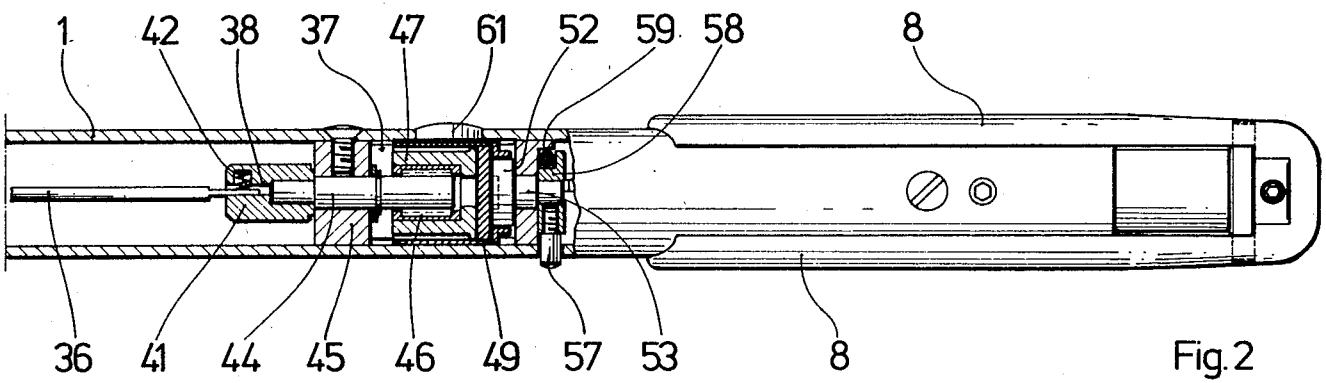
FIG. 2 shows a bottom plan view of the handle region of a device according to this invention, partially broken away and in sectional view.

The device according to this invention for tightening a screw fastening includes both a torque device as well as an angle of rotation device and makes it possible to use the two devices together for tightening screw fastenings beyond the yield point with the help of a means of controlling the angle of rotation in a continuous tightening operation, i.e., preliminary tightening with the jointing torque and further tightening by an angle $\theta$ into the plastic range of the screw can now take place in one tightening operation without stopping and starting, and the point of reaching the desired angle of rotation can be read directly from the device according to this invention and furthermore, any desired jointing torque for pretightening up to the starting point of the angle of rotation measurement can be preset.

First, that part of the device according to this invention which makes it possible to tighten a screw fastening up to any jointing point as a function of the torque will be described with reference to the figures. This torque device according to this invention consists of a tubular housing (1), preferably with a rectangular cross section. An inserting tool (2) which may be designed in the form of a ratchet, a square or ring wrench, or an open-jawed wrench can be inserted into the end of the tubular housing (1). At the other end there is a handle (3) which can pivot in the tubular housing (1).

The handle (3) is mounted so that it can pivot by means of parallel guides consisting of two pairs of levers (4, 6), so that one end of each lever (4, 6) in each pair is mounted in the handle. The other ends of each lever (4, 6) is hinged to a connecting body (7) which is mounted on the housing inside the tubular housing (1). The handle (3) has a U-shaped cross section, and the free legs (8) of the U surround the connecting body (7) as well as the respective end (9) of the tubular housing (1) where the end (9) also has a U-shaped cross section and the height of the three perpendicular legs of the U correspond approximately to one-half the height of the tubular housing (1). This arrangement described here permits a parallel pivoting movement of the handle (3) which is limited in the starting position by the perpendicular edge of the tubular housing (1) and in the end position by the horizontal edges of the U legs of the end of the tubular housing (9).

Inside the handle (3) there is a bending rod (11), preferably in the form of a flat spring, which is attached at one end to the upper bearing axis (12) of the pivot lever (4) and the other end is inserted into an adjusting slide (13). The adjusting slide (13) can move inside the handle (3) at a right angle to the longitudinal axis of the handle. An adjusting screw (16) passes through a threaded hole (14) in the adjusting slide (13) so that one end rests against a stop (17) in the handle (3) and on the opposite end preferably has a hexagon socket for operating it. By turning the adjusting screw (16), the adjusting slide (13) is shifted and thus also there is a corresponding displacement of the end of the bending rod (11) which is held in the slide (13). This shift is indicated by the double arrow (Y). When tightening the screw connection, the bending rod (11) is moved together with the handle (3) until the handle rests against the U legs of the ends of the tubular housing (9) in the end position. In the course of this movement, the bending rod (11) comes to rest against a stop (18) whereupon the handle (3) can be moved only against the resistance of the bending rod as far as the end position. The stop (18) is formed by a bolt which is screwed into the connecting body (7) and its distance from the bending rod (11) is adjustable. Preferably, the stop (18) is near the middle of the bending rod (11) and runs parallel to the direction of movement in accordance with the arrow (Y).

Figure 4:
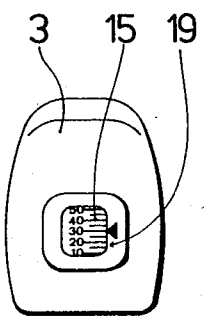
FIG. 4 shows a view according to arrow IV in FIG. 3.
Figure 5:
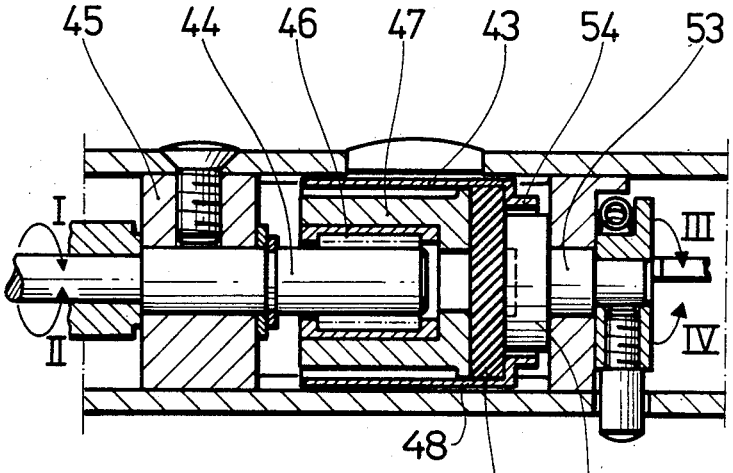
FIG. 5 shows a section through an angle indicator according to this invention, shown on an enlarged scale.
Figure 6:
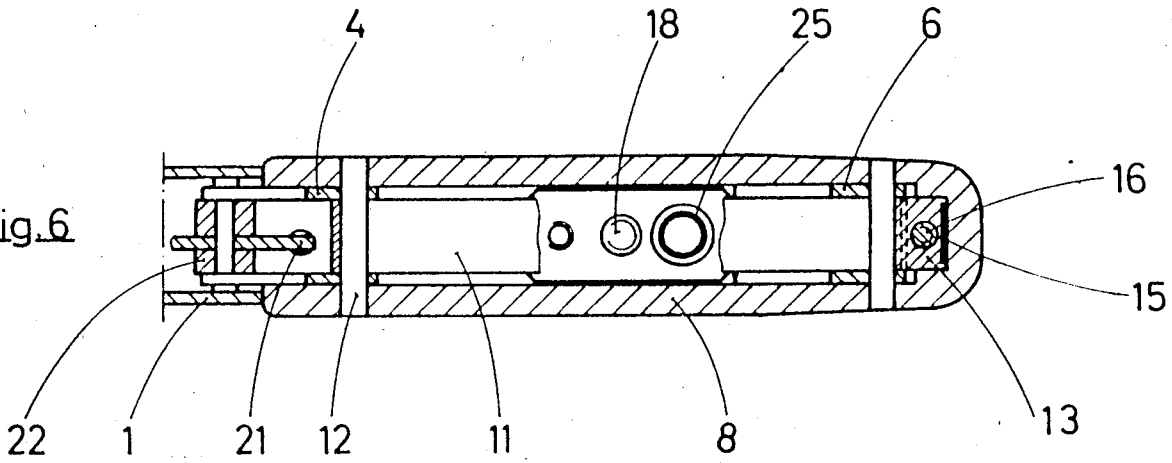
FIG. 6 shows a section through the handle region, taken along line VI—VI of FIG. 3.
Figure 8:
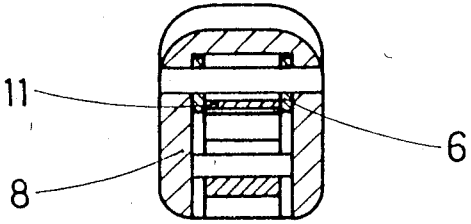
FIG. 8 shows a section taken along line VIII—VIII of FIG. 3.
Figure 7:
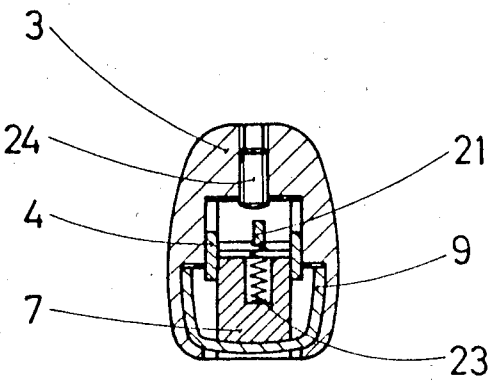
FIG. 7 shows a section view taken along line VII—VII of FIG. 3.

The torque adjusting device is calibrated by means of the stop (18). Depending on the calibration, the following relationship holds: The greater the distance between the bending rod (11) and the stop (18), due to the change in position of the bending rod (11) by means of the sliding body (13), the smaller is the resistance to be overcome to the end position of the handle (3) due to the slight deflection of the bending rod (11). It is also true that the smaller the distance between the bending rod (11) and the stop (18), the greater is the resistance to be overcome because there is a great deflection of the bending rod. The force required to overcome the prevailing resistance is applied to the handle (3) and results in a size-dependent torque in the screw fastening that is being tightened by means of the tubular housing (1) which acts as a power arm. A scale (15) for the tightening torque to be applied with the device according to this invention is mounted on the sliding body (13) in the vicinity of an aperture (19) (see FIG. 4) in the front end of the handle (3), so the desired tightening torque or jointing torque can be preset. When this preset tightening torque is achieved in the end position of the handle (3), a visible or audible signal is triggered, for example, if the device according to this invention is used strictly as a torque wrench, or if it is also used for tightening screw fastenings beyond the yield point by controlling the angle of rotation, then an angle of rotation measurement device is released, as described below.

Due to a compression spring (25) mounted in the connecting body (7) and adjacent to the bending rod, the handle (3) returns to its original position when released. The triggering or release mechanism consists of a release lever (21) which is held so that it can swing in a bearing block (22) of the connecting body (7), preferably approximately in the center. A compression spring (23) which is located between the end of the lever and the connecting body (7) presses against the rear end of the lever from beneath so that the release lever (21) assumes a position approximately parallel with the longitudinal axis of the tubular housing, corresponding to the starting position before operation. Above the rear end of the release lever (21) a release stop (24) is screwed into the handle (3) and its distance from the release lever in the starting position of the handle is adjusted so that after reaching the end position of the handle, the release lever is moved to the release position. In this way, the front operating end of the release lever (21) fulfills the actual triggering function, e.g., for a visual or acoustic signal. In the advantageous practical example depicted here, this triggers an angle measurement and indicating device.

Instead of the size of the torque required to trigger said device being adjusted by means of the adjusting slide (13), it can be designed in a rigid version and the adjustment can take place exclusively by adjusting the stop (18). The size of the torque with each of the adjustment versions described here essentially also depends on the rigidity of the bending rod and is ultimately determined by the length of the tubular housing (1).

In addition, the present invention also includes a device for measuring and indicating the angle of rotation in tightening a screw fastening. This invention concerns not only this device alone but also this device in combination with the torque-controlled triggering mechanism described above. The angle of rotation measurement and indicating device according to this invention consists of a head gear (26) in the front end of the tubular housing (1) which can rotate about a vertical axis of rotation (Z). The vertical axis of rotation (Z) corresponds to the axis of rotation of a screw fastening to be tightened (not shown). A square wrench (27) can be inserted coaxially into the gear (26) with a lever arm (28) attached to it so that it can pivot and rotate. A magnet (29) is attached preferably to a bent end of the lever arm (28) so that it can rotate about the axis of the bent end. This magnet (29) is used to secure the lever arm (28), e.g., to a housing which has the screw fastening that is to be tightened. Instead of the friction-locking connection, a positive connection may also be provided. In this way, the starting position for the angle of rotation measurement is fixed at the same time because the lever arm (28) is connected to the head gear (26) by the square wrench (27). When the tubular housing (1) is rotated about the axis of rotation (Z) which also forms the axis of rotation and central axis of the insertion tool (2), the rotation of the head gear relative to the tubular housing is thus a measure of the angle of rotation of the screw fastening to be tightened.

The transfer of the relative rotation of the head gear (26) takes place by means of a toothed belt (31) which meshes with the head gear (26), preferably in a 1:1 ratio on an angle-indicating device as described below. Due to the use of the toothed belt (31), deflection of the rotation of the head gear (26) about the axis of rotation of the screw fastening to be tightened can take place by simple means in an axis perpendicular to the screw running in the longitudinal direction of the tubular housing (1). This results in a space-saving design. After being looped around the head gear (26), the toothed belt (31) assumes a position at a right angle to the axis of rotation of the gear, and both sides of the toothed belt are passed over deflector rolls (32) on a deflector gear (33) which has an axis of rotation that runs at a right angle to the axis of rotation of the head gear (26) in the direction of the longitudinal axis of the tubular housing (1), and is also supported like the deflector rolls (32) on a bearing body (34) mounted in the tubular housing (1). The bearing body (34) is mounted so that it can slide in the tubular housing against the pressure of a helical spring (35), so that the toothed belt is always under a uniform tension. Any rotational movement of the head gear is then transferred to the shaft (44) of an angle indicator (37) by means of a connecting rod (36) with a length which depends on the length of the tubular housing (1). The connecting rod (36) is connected to the deflector gear and the angle indicator (37) so that its rotation is locked but it can slide in the longitudinal direction and can also compensate for any slight inclined positions, so that any mismatching and inaccuracy in assembly, as well as twisting of the tubular housing, can be compensated and thus any impairment in the transfer of the movement can be avoided. The connecting rod (36) is designed as a flat edge at both ends and guided in a slot (38), and the slots (38) are in extensions (39, 41) of the deflecting gear wheel (33) and of the shaft (44) of the angle indicator (37). The flat edge ends are held in the slots of the projections (39, 41) by compression springs (42).

The angle indicator (37) thus fulfills the following requirements according to this invention:

1. Locking of a scale drum (43) in zero position, e.g., by means of a release lever (21), when the tubular housing (1) is turned in the tightening direction and there is a corresponding turn of the head gear (26).

2. Immediate rotation of the scale drum after release when a preset torque is exceeded during any movement of the tubular housing in the direction of tightening and a corresponding rotation of the head gear.

3. Securing the scale drum when the tubular housing is turned against the direction of tightening, despite the rotation of the head gear.

4. The possibility of adjusting the zero position of the scale drum when the head gear is stationary.

In order for the preceding requirements to be satisfied, the angle indicator (37) according to this invention consists of a shaft (44) which is mounted in a housing (45) and is secured to prevent movement on both ends of the bearing bore and is linked to the connecting rod (36) on the outer end of the shaft and in this way also follows any rotational movement of the head gear (26). A bypass opening (46) is provided on the inside end of the shaft, especially a needle bypass opening which is pressed with its housing in a driving sleeve (47) which surrounds it. The bypass opening (46) locks the shaft (44), e.g., in the direction of rotation indicated by the arrow (I). The driving sleeve (47) is made of steel and its front, which has a rotating heel (48), adheres to the inside of the disk-shaped double-acting permanent magnet (49) which is inserted into the scale drum (43) as a bottom and is connected rigidly to it. The scale drum surrounds the driving sleeve (47) and is guided radially by its heel (48). When the driving sleeve (47) rotates, the permanent magnet is carried along with the scale drum as a result of the magnetic force and the resulting frictional force. A return disk (52) is secured in the housing (1) on the side opposite the shaft (44) by means of a one-piece bearing projection (53) so that it cannot slide. The permanent magnet (49) adheres with its outside to the front of the return disk (52) which is smaller than the front of the driving sleeve (47) so that this results in a slight entraining frictional force due to the magnetic force. An attachment disk (58) is attached to a pin on the return disk (52) which projects out of the housing (45) to the rear. This attachment disk is held together with the return disk against a fixed stop of the housing (45) by means of a compression spring (59) rotating in the attachment disk so that its spring force acts in the direction of rotation III and is greater than the entraining frictional force counteracting the rotation. An operating pin (57) which projects outward through an aperture in the tubular housing (1) and is mounted radially in the attachment disk makes it possible to manually initiate a rotational movement of the return disk of about 60° against the back pressure of the compression spring (59). In the vicinity of the return disk (52), the scale drum (43) has a cylindrical projection (54). At the circumference of this projection, there is a locking nose (56) which acts together with the release lever (21) of the torque device.

Figure 3:
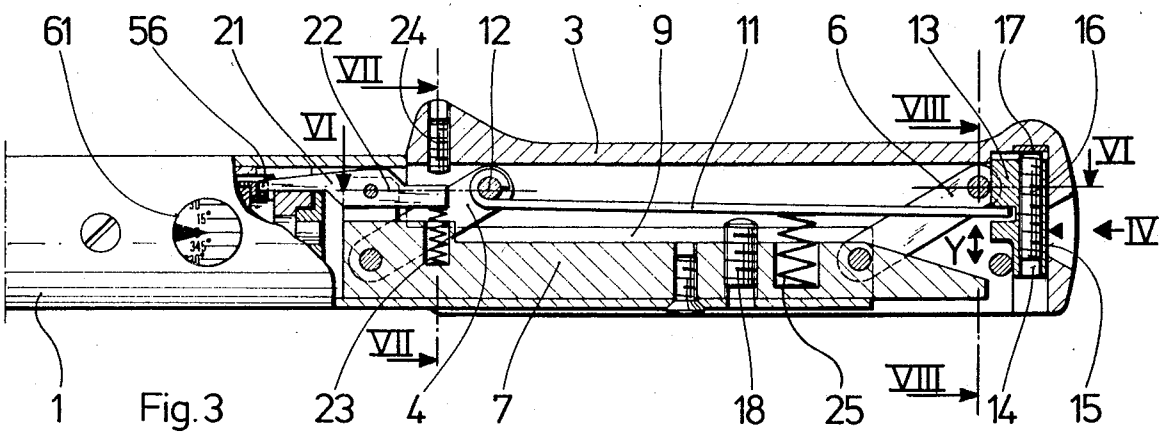
FIG. 3 shows a side elevation view of the handle region according to FIG. 2, partially broken away and in sectional view, but rotated 90° in comparison with FIG. 2.

The operation can be described as follows: When the release lever (21) is in the starting position shown in FIG. 3, the locking nose (56) of the scale drum (43) is in contact with its tip so that rotation of the scale drum (43) together with the permanent magnet (49) in the direction of rotation I is blocked. Then when the shaft (44) is turned in the direction of the arrow I in the tightening operation owing to the rotation of the head gear (26), the driving sleeve (47) is entrained owing to the barrier of the bypass opening (46), overcoming the frictional force between the driving sleeve (47) and the permanent magnet (49) which is locked together with the scale drum (43). When the torque device is released by raising the release lever (21) above the locking nose, the locking nose (56) is released and in this way the scale drum (43) with the permanent magnet (49) is also released so that it can be entrained by the driving sleeve (47) as a result of frictional force, and the lower frictional force to the spring-mounted return disk is overcome. Since the rotation of the head gear (26) is preferably transferred to the scale drum in a 1:1 ratio, the tightening angle after reaching the release moment can be read on the scale drum by means of an appropriate degree scale shown on the circumference of the scale drum. Therefore, a window (61) with a zero point mark is provided above the scale drum (43) in the tubular housing (1).

It is provided that according to this invention, when the tubular housing (1) is turned back against the direction of tightening, e.g., when using a ratchet set (2) which permits repeated tightening in small angle increments, the scale drum does not turn backward, but instead remains in the resulting position achieved so that addition of the individual angle steps is also shown on the scale drum. This is possible due to the fact that the driving sleeve (47) does not move back when the shaft (44) turns back in the direction II owing to the bypass opening (46) which now takes effect and due to the adhesive connection of the driving sleeve (47) as well as the fixed return disk (52) with the permanent magnet (49), the scale drum (51) remains fixed. After conclusion of the tightening operation and releasing the handle (3), the release lever (21) returns to its starting position and is ready for locking.

To bring the scale drum back to the zero position from the indicating position achieved in order to carry out the next tightening operation, i.e., to bring the locking nose (56) to rest against the tip of the release lever (21), this can be accomplished by making a few turns about the axis (Z) of the head gear (26) with the lever arm (28) fixed and the wrench raised from the tightened screw fastening, or this can be accomplished by turning the next screw fastening to be tightened. In addition, the zero point setting can be achieved by first moving the return disk (52) against the spring force of the compression spring (59) by hand in the direction IV by means of operating pin (57) which does not result in any entrainment of the scale drum (43) but instead the frictional force of the return disk against the permanent magnet (49) is overcome because both the locking of the bypass opening (46) as well as the frictional force between the permanent magnet and the driving sleeve oppose a greater resistance. After releasing the operating pin, the return disk is returned in the direction III by the spring force of compressive spring (59) so that the permanent magnet is entrained with the scale drum by the return disk and the drive disk is entrained by the permanent magnet in the direction of the bypass opening. Here again, the return can take place in several steps until the locking nose is again in contact with the release lever.

The device according to this invention is characterized by the fact that it can be designed to be very compact so that it can easily be used in difficultly accessible locations. In addition, it permits tightening beyond the yield point in one tightening operation without starting or stopping by controlling the angle of rotation. The critical angle of rotation can easily be read because the angle of rotation indicator is located a certain distance away from the screw fastening itself.

I claim:

1. In an apparatus for tightening threaded connecting means comprising an elongated housing having a first end and a second end, means for engaging said threaded connecting means for rotation about a thread axis, said engaging means being provided at said first end of said housing, a handle provided at said second end, torque responsive means responsive to a given torque about said thread axis being exerted on said handle, and angle measuring means for measuring an angle through which said threaded connecting means have been rotated about said thread axis by said engaging means, the improvement comprising:

said angle measuring means including an input member mounted for rotation relative to said housing and coaxially with said thread axis;

means associated with said input member for holding the input member against rotation in space, as said housing rotates about the thread axis;

angle indicating means associated with said housing; and transmission means operative for transmitting rotary motion of said input member, relative to said housing, to said angle indicating means;

said transmission means comprising slip clutch means permitting rotation of said input member when said angle indicating means is locked against rotation;

locking means operative for locking said angle indicating means in a zero position; and said locking means is operative in response to said torque responsive means to release said angle indicating means when said given torque is exerted on said handle, so that the angle indicating means is locked in its zero position until the given torque is exerted, and thereafter is unlocked to indicate the angle of rotation of the threaded connecting means when tightened further.

2. An apparatus as in claim 1, wherein said torque responsive means comprises:

parallel motion means for connecting said handle to said housing;

bending rod means operatively associated with said handle;

stop means disposed on said housing for engagement of said bending rod means whereby a torque can be transmitted from said handle through said bending rod means and said stop means to said housing, the movement of said handle relative to said housing being a function of said torque; and means responsive to said movement of said handle relative to said housing for releasing said locking means.

3. Apparatus as claimed in claim 2, wherein said responsive means comprise:

a two-armed lever pivotably mounted in said housing for movement between a first position and a second position;

a spring operatively disposed to urge said lever into said first position; and means on said handle for engaging said two armed lever and for moving that lever into said second position against the action of said spring.

4. An apparatus for tightening threaded connecting means, comprising:

an elongated housing having a first end and a second end;

means for engaging said threaded connecting means for rotation about a thread axis, said engaging means being provided at said first end of said housing;

a handle at said second end;

parallel motion means for connecting said handle to said housing;

bending rod means operatively associated with said handle and comprising a bending rod having a first and a second end, said first end being attached to said handle;

stop means disposed on said housing for engagement of said bending rod means whereby a torque can be transmitted from said handle through said bending rod means and said stop means to said housing, the movement of said handle relative to said housing being a function of said torque;

means responsive to said movement of said handle relative to said housing to indicate a predetermined torque;

adjusting slide means adjustably mounted in said handle; and said second end of said bending rod engaging said adjusting slide means, so that the distance between the bending rod and the stop means, and thus the amount of said torque, is selectable in response to said adjusting slide means.

5. Apparatus as claimed in claim 4, wherein said adjusting slide means comprise:

an adjusting slide slidably guided in said handle, and having a threaded bore therethrough and having a recess engaged by said second end of said bending rod;

a stop at said handle; and an adjusting screw having an end engaging said stop and screwed into said threaded bore.

6. An apparatus for tightening threaded connecting means, comprising:

an elongated housing having a first end and a second end;

means for engaging said threaded connecting means for rotation about a thread axis, said engaging means being provided at said first end of said housing;

a handle at said second end;

parallel motion means for connecting said handle to said housing;

bending rod means operatively associated with said handle;

stop means disposed on said housing for engagement of said bending rod means whereby a torque can be transmitted from said handle through said bending rod means and said stop means to said housing, the movement of said handle relative to said housing being a function of said torque;

means responsive to said movement of said handle relative to said housing to indicate a predetermined torque;

said parallel motion means comprising first and second links, said links having equal lengths and having first and second ends each, said first end of the first link being pivotably connected to said housing by means of a first axle, and said first end of the second link being pivotably connected to said housing by means of a second axle, said second end of said first link being pivotably connected to said handle by means of a third axle, and said second end of the second link being pivotably connected to said handle by means of a fourth axle; and said first end of said bending rod being pivotably mounted on said third axle, so that the movement of the third axle and of said handle is resisted by bending of said bending rod.

7. Apparatus as claimed in claim 6, and further comprising:

a connecting body forming part of said housing and projecting therefrom at said second end of the housing, said first and second axles of said parallel motion means being held in said connecting body;

a compression spring arranged between said connecting body and said bending rod to urge said handle into an inoperative position; and said stop means comprising an adjustable stop on said connecting body, whereby the distance between said stop means and said bending rod in said inoperative position of said handle is adjustable.

8. An apparatus for tightening threaded connecting means, comprising:

an elongated housing having a first end and a second end;

means for engaging said threaded connecting means for rotation about a thread axis, said engaging means being provided at said first end of said housing;

a handle at said second end and defining a cavity;

parallel motion means for connecting said handle to said housing;

bending rod means operatively associated with said handle;

stop means disposed on said housing for engagement of said bending rod means whereby a torque can be transmitted from said handle through said bending rod means and said stop means to said housing, the movement of said handle relative to said housing being a function of said torque;

means responsive to said movement of said handle relative to said housing to indicate a predetermined torque, and comprising a two-armed lever pivotably mounted in said housing for movement between a first position and a second position;

a compression spring operatively disposed to urge said lever into said first position;

means on said handle for engaging said two-armed lever and for moving that lever into said second position against the action of said spring;

said two-armed lever having a first arm extending into said cavity of said handle, and having a second arm extending into said housing;

said spring acting on said first arm; and said engaging means comprises a stop provided on the inside of said cavity and arranged to engage said first arm on the side remote from said compression spring.

9. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing;

transmission means for transmitting rotation of said input member, relative to said housing, to said angle indicating device;

said input member being a first gear;

said transmission means comprising an endless toothed belt, a second gear rotatably mounted in said housing about an axis of rotation orthogonal to the axis of rotation of said first gear and substantially in a longitudinal direction of said elongated housing, and a pair of deflector rollers rotatably mounted in said housing on both sides of said second gear about aligned axes which lie in a plane normal to the axis of rotation of said second gear;

said toothed belt passing from said first gear in said longitudinal direction, around one of said deflector rollers, around said second gear in mesh therewith, around the other one of said deflector rollers and around said first gear in mesh therewith.

10. Apparatus as claimed in claim 9, wherein:

said second gear and said deflector rollers are mounted on a bearing body, and said bearing body is movably guided in said housing in said longitudinal direction and includes spring biased means to tension said toothed belt.

11. Apparatus as claimed in claim 9 and further comprising:

a connecting rod extending substantially in said longitudinal direction and having a first end and a second end, said first end being in driving engagement with said second gear for rotation therewith and said second end drivingly engaging said angle indicating means.

12. Apparatus as claimed in claim 11, wherein said connecting rod is longitudinally slidable relative to both said second gear and said angle indicating means.

13. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing and comprising a drum having an angle graduation on its peripheral surface and mounted for rotation about a longitudinal axis of said housing;

transmission means for transmitting rotation of said input member, relative to said housing, to said angle indicating means;

said drum having a bore therethrough;

a disc-shaped permanent magnet fixed in one end of said bore;

a driving sleeve made of ferro-magnetic material and having a plane end face arranged in said sleeve, said end face frictionally engaging said magnet under the action of magnetic force exerted by said magnet;

said transmission means comprising a shaft in driving connection with said input member and extending into said sleeve; and said transmission means further comprising means for transmitting motion in one direction only, including free-wheel means arranged between said shaft and said sleeve.

14. Apparatus as claimed in claim 13, and further comprising means for returning said drum to a reference position, said returning means comprising:

a disc of ferro-magnetic material which is rotatably mounted in said housing coaxially with said shaft and has a contact face engaging an end face of said permanent magnet remote from said driving sleeve;

said contact face having an area smaller than the area of the end face of said driving sleeve;

a radial lever provided on said disc and extending through an aperture of said housing; and return spring means acting on said disc to hold the disc in an end position, from which the disc angularly movable by means of said radial lever.

15. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing and comprising a drum having an angle graduation on its peripheral surface and mounted for rotation about a longitudinal axis of said housing;

transmission means for transmitting rotation of said input member, relative to said housing, to said angle indicating device;

slip coupling means in said transmission means for permitting rotation of said input member, when said drum is held against rotation;

a locking nose radially projecting from the periphery of said drum;

a two-armed lever pivotably mounted in said housing for movement between a first position and a second position; and biased towards said first position;

said two-armed lever engaging said locking nose in said first position to thereby retain said drum in a reference position, and releasing said locking nose in said second position; and torque responsive means responding to the torque exerted through said housing on said engaging means, said torque responsive means being arranged to move said two-armed lever from said first position to said second position when a given torque has been reached, whereby said drum is retained in its reference position until a given torque has been exerted and indicates the angle of rotation of said engaging means thereafter.

16. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing; and transmission means for transmitting rotation of said input member, relative to said housing, to said angle indicating device, said transmission means comprising free-wheel means for transmitting rotary motion in one direction only.

17. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing;

transmission means for transmitting rotation of said input member, relative to said housing, to said angle indicating device;

releasable retaining means for retaining said angle indicating means in a predetermined reference position; and said transmission means comprising slip coupling means for permitting rotation of said input member, while said angle indicating means are held by said releasable retaining means.

18. Apparatus as claimed in claim 17, and further comprising torque responsive means responding to the torque exerted through said housing in said engaging means, said torque responsive means being operative to release said releasable retaining means in response to reaching a given torque.

19. Apparatus for tightening threaded connecting means, comprising:

an elongated housing;

means for engaging said threaded connecting means for rotation about an axis, said engaging means being attached to said housing;

an input member rotatably mounted in said housing about an axis of rotation coaxial with said axis of said engaging means;

holding means for holding said input member against rotation when said housing is rotated;

angle indicating means provided in said housing;

transmission means for transmitting rotation of said input member, relative to said housing, to said angle indicating device; and means for setting said angle indicating means to a predetermined reference position.

* * * * *